US008146173B2

(12) United States Patent
Kim

(10) Patent No.: US 8,146,173 B2
(45) Date of Patent: Apr. 3, 2012

(54) GOLF GLOVE FOR RIGHT GRIP AND SUITABLE SWING

(76) Inventor: Jeong Yong Kim, Gyeonggi-do (KR)

( * ) Notice: Subject to any disclaimer, the term of this patent is extended or adjusted under 35 U.S.C. 154(b) by 262 days.

(21) Appl. No.: 12/447,628

(22) PCT Filed: Dec. 4, 2007

(86) PCT No.: PCT/KR2007/006225

§ 371 (c)(1),
(2), (4) Date: Apr. 28, 2009

(87) PCT Pub. No.: WO2008/069535

PCT Pub. Date: Jun. 12, 2008

(65) Prior Publication Data

US 2010/0043119 A1 Feb. 25, 2010

(30) Foreign Application Priority Data

Dec. 6, 2006 (KR) ..... 10-2006-0122696
May 4, 2007 (KR) ..... 10-2007-0043761

(51) Int. Cl.
*A41D 19/00* (2006.01)

(52) U.S. Cl. ..... 2/161.2

(58) Field of Classification Search ..... 2/161.2, 2/161.4, 161.5, 163, 16, 159
See application file for complete search history.

(56) References Cited

U.S. PATENT DOCUMENTS 2,264,366 A 12/1941 Du Bois
2,270,882 A 1/1942 Link
2,302,875 A 11/1942 Lykins
2,700,159 A * 1/1955 Van Denburgh ..... 2/20
2,751,598 A * 6/1956 Romeo ..... 2/161.3
2,975,429 A * 3/1961 Newman ..... 2/161.2
3,100,302 A 8/1963 Billings
3,369,258 A 2/1968 Smith
3,387,306 A * 6/1968 Korey ..... 2/159
4,882,787 A * 11/1989 Hull et al. ..... 2/161.5
5,146,627 A * 9/1992 Weiser ..... 2/161.2
5,423,089 A * 6/1995 Chun et al. ..... 2/161.2
5,500,956 A 3/1996 Schulikn et al.
5,628,068 A * 5/1997 DeLong ..... 2/161.1
5,768,709 A * 6/1998 Newkirk et al. ..... 2/160
6,035,443 A * 3/2000 Green ..... 2/161.2
6,195,803 B1 * 3/2001 Russell et al. ..... 2/161.1
6,216,276 B1 * 4/2001 Eibert ..... 2/161.2
6,675,392 B2 * 1/2004 Albert ..... 2/161.1
7,062,791 B2 * 6/2006 Gold ..... 2/161.6
7,780,541 B2 * 8/2010 Bauer ..... 473/205

* cited by examiner

*Primary Examiner* — Danny Worrell
(74) *Attorney, Agent, or Firm* — Park & Associates IP Law, P.C.

(57) ABSTRACT

The present invention is a golf club which induces proper grip and suitable swing by removing the thumb-covering portion of a golf glove so as to extend the Skin Contact Length between the thumb and forefinger. Due to the absence of a thumb covering, structural problems with the glove covering stretching from the thumb area toward the palm may arise when centrifugal force is imparted by the golf club. If the glove covering has been stretched, the covering will become folded when the club is gripped; this causes a pull on the left thumb when gloves are worn and leads to improper grip. Therefore, in order to provide elasticity with regard to stretching, in place of sheepskin the area subject to stretching is processed with a Spandex material having excellent elasticity and flexibility.

5 Claims, 8 Drawing Sheets

[Fig. 1]
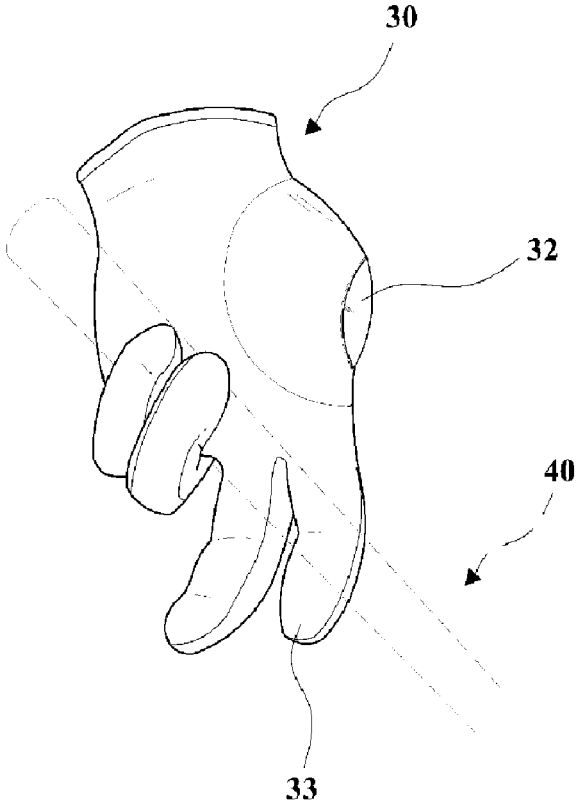
[Fig. 2]
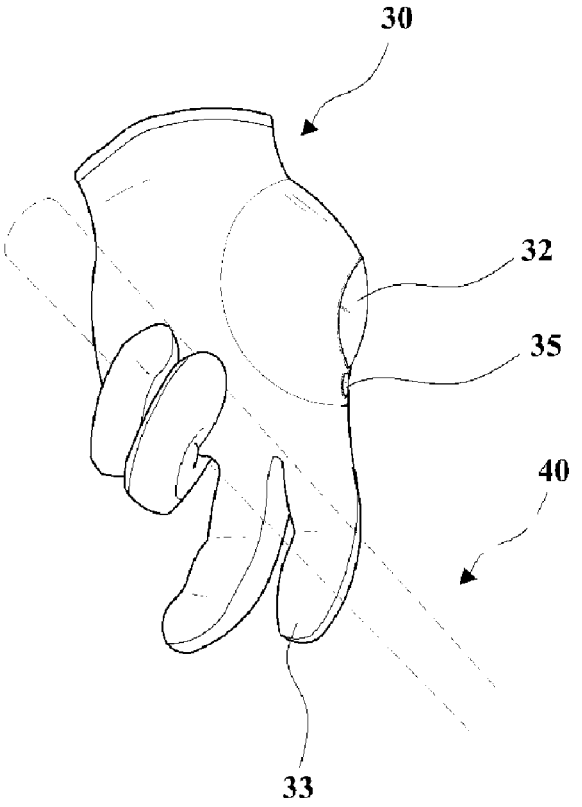

[Fig. 3]
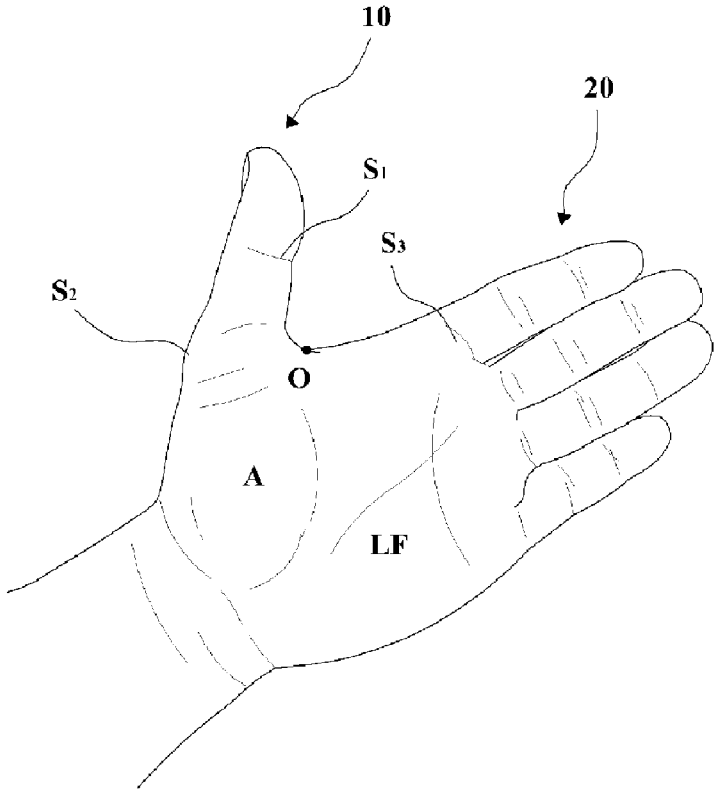
[Fig. 4]
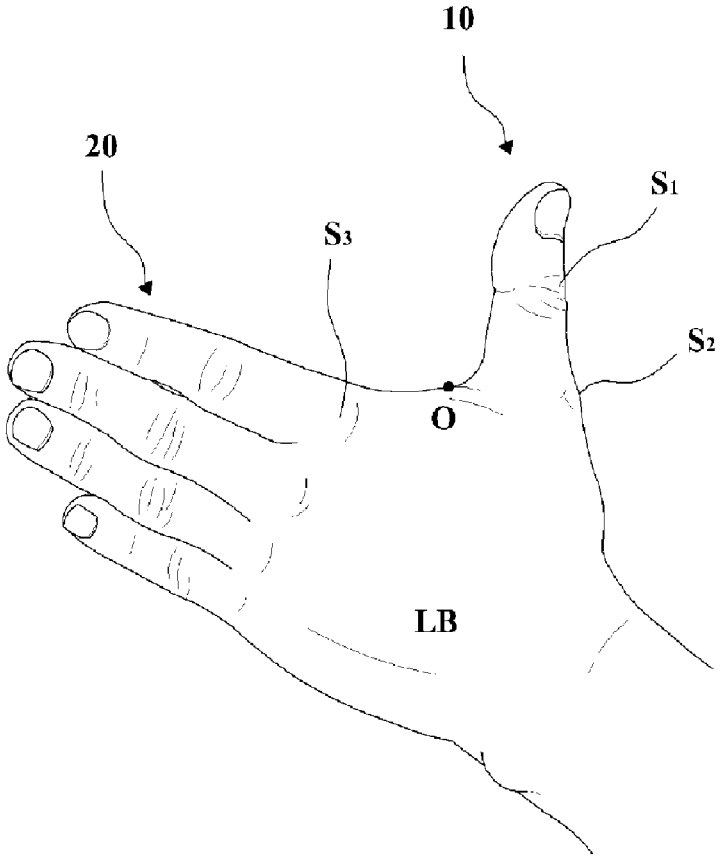

[Fig. 5]
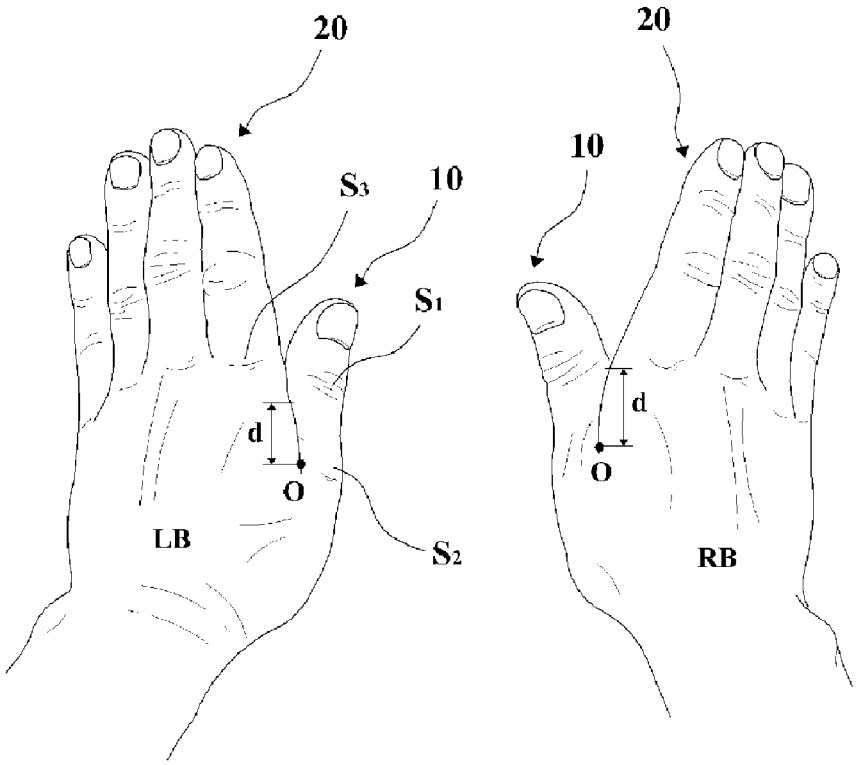
[Fig. 6]
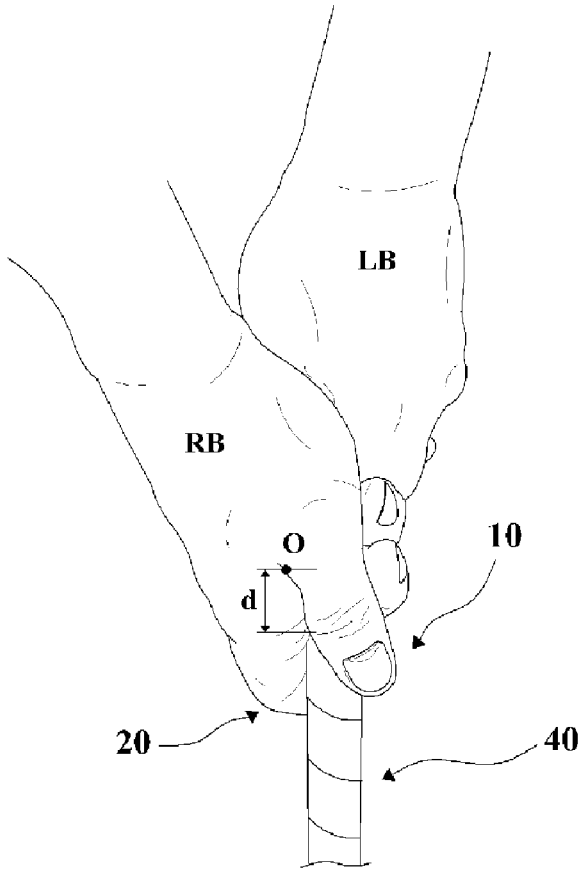

[Fig. 7]
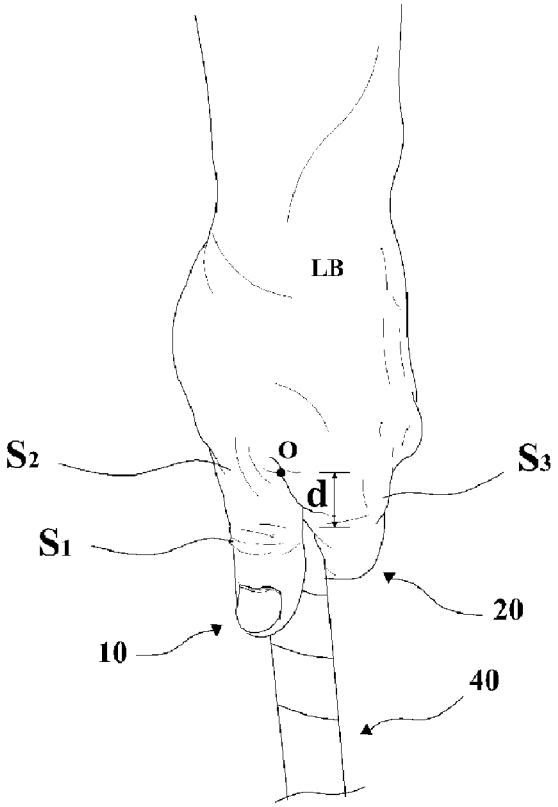
[Fig. 8]
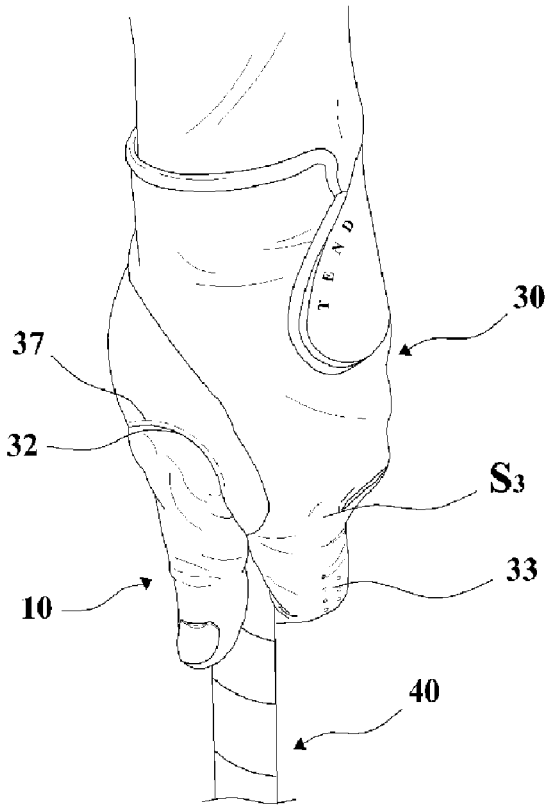

[Fig. 9]
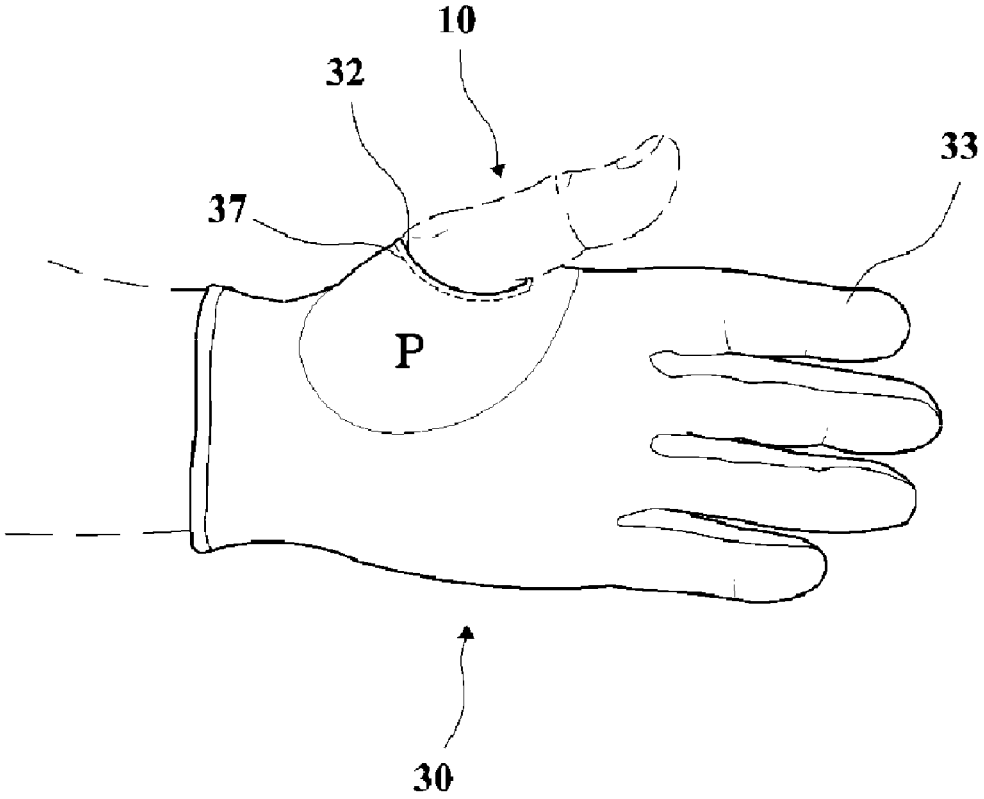
[Fig. 10]
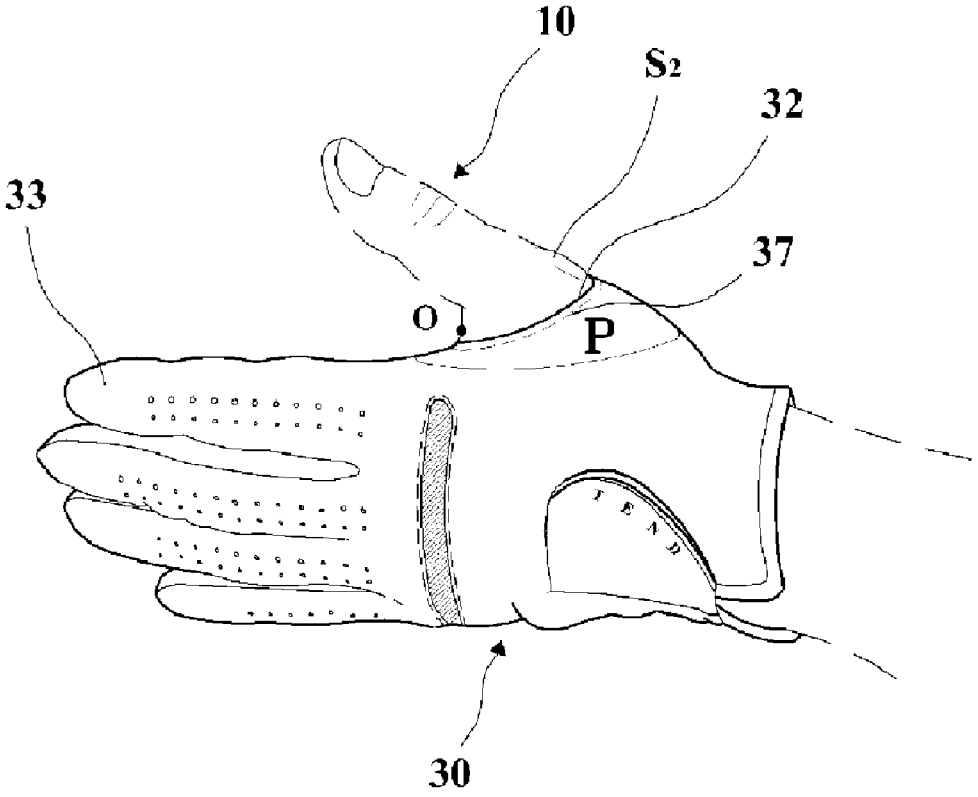

[Fig. 11]
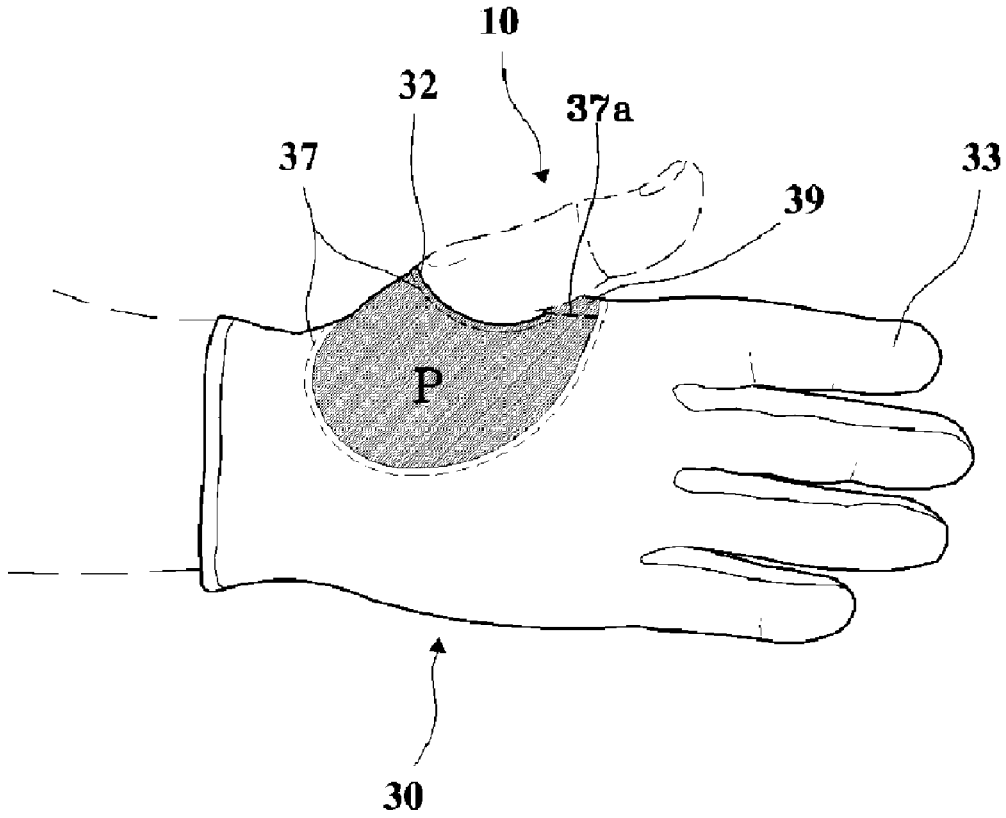
[Fig. 12]
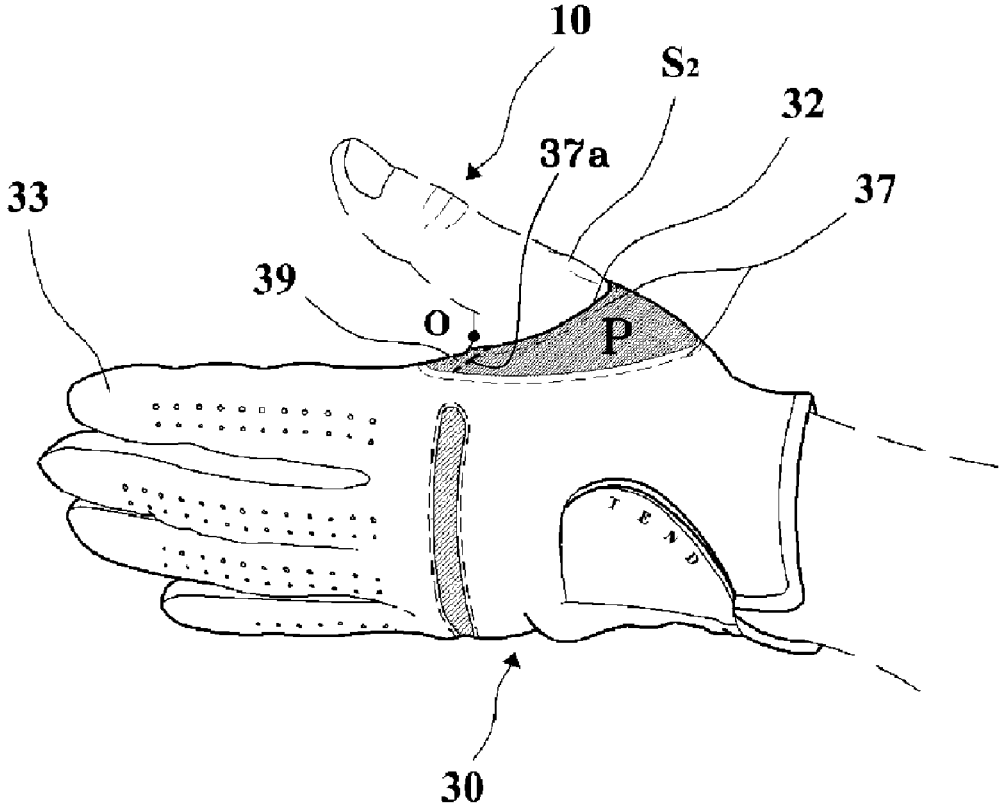

[Fig. 13]
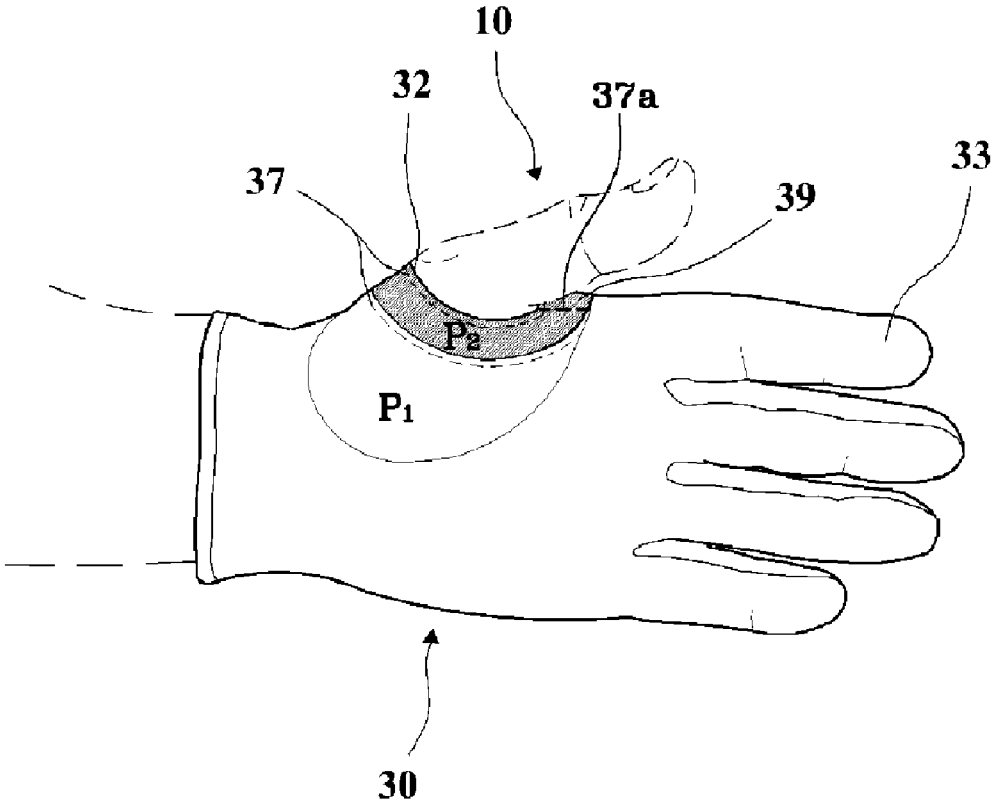
[Fig. 14]
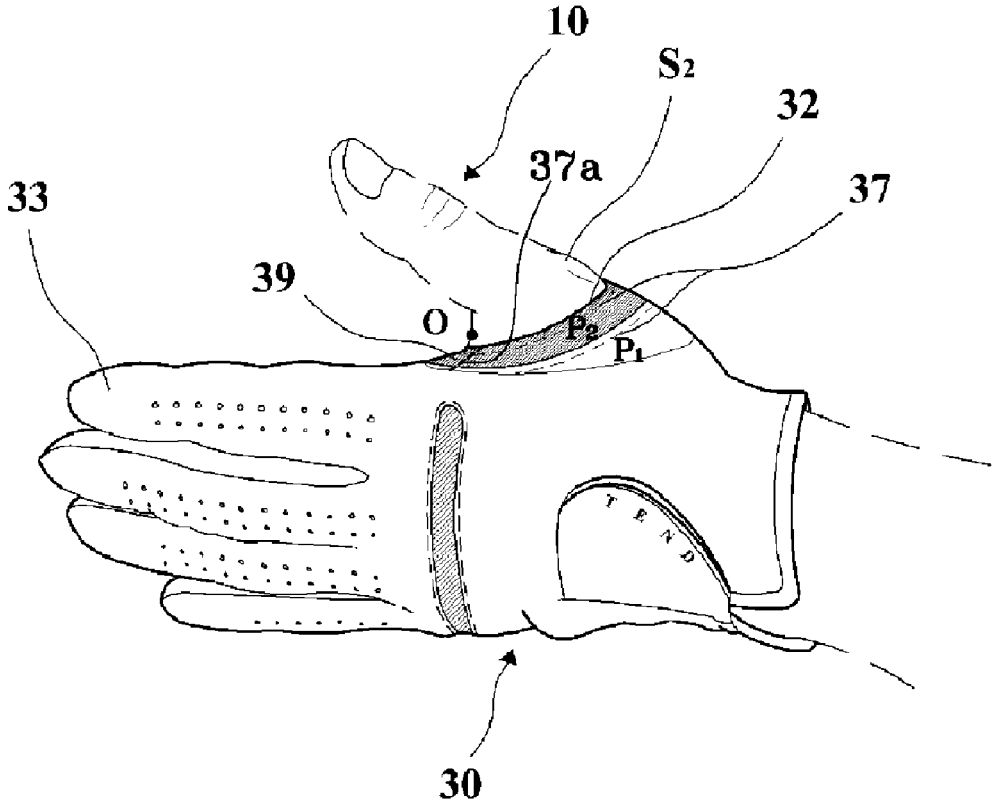

[Fig. 15]
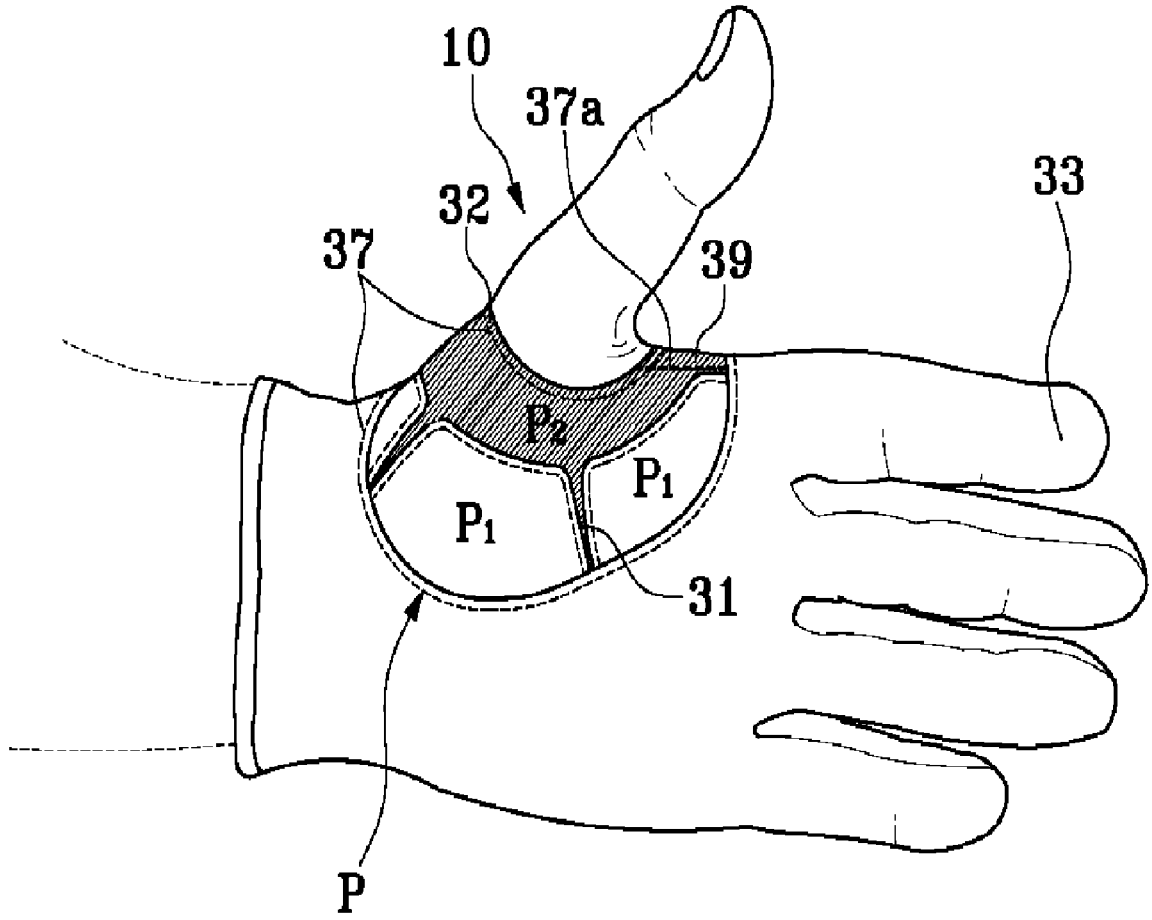
[Fig. 16]
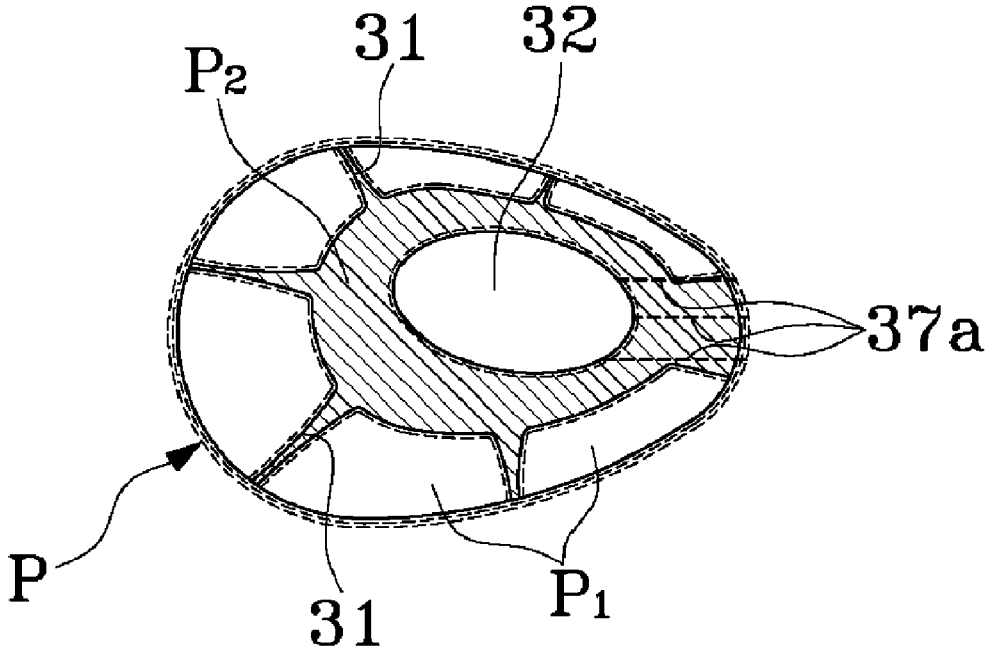

GOLF GLOVE FOR RIGHT GRIP AND SUITABLE SWING

TECHNICAL FIELD

The present invention concerns a golf glove which induces a suitable swing through a proper grip. Specifically, this invention has the purpose of allowing the golfer to sense by touch whether the thumb and forefinger are in skin contact over the Skin Contact Length (d), so as to induce a suitable swing through a proper grip with the thumb and forefinger in skin contact over the Skin Contact Length (d). In other words, this invention concerns a golf glove through which it has been sought to obtain a suitable swing by maintaining a proper grip from address position through backswing to impact.

BACKGROUND ART

In general, in golfing the ball is sent in the desired direction and for the desired distance by the swing. The swing is the action of swinging the club to hit the ball. Club and body are linked by the hands. Thus, to swing the club is to swing one's arms. As a precision activity, golf calls for a higher degree of attention, focus, and reflex conditioning than other activities requiring attention, in as much as the golfer must envision the target while focusing on the stationary ball.

The swing is a single motion, comprising the following series of motions:

Address→Backswing→Top of Backswing→Downswing→Impact→Followthrough→Finish

A. Address Position

'Address position' refers to the body's pre-swing stance, in preparation for a proper swing. That is, the address is the stationary starting posture for the swing motion.

In other words, the address is the position in which the current location of the stationary ball and the target location are gauged, a club suitable for the distance is chosen, and the direction of the ball and club face are set. Notably, the grip is completed in the address position.

Because the address position lays the groundwork for hitting the ball, most unintended missed shots in the field arise from the address. The chief factor in the address causing incorrect ball direction is the grip. Incorrect ball direction is generally due to an improper grip. A proper grip leads to a suitable swing.

B. Backswing and Top of Backswing

The backswing is the motion in which the power is gathered through the motion of the club (including the hands and arms) and club face. The backswing comes to a stop at the top of backswing. The top of backswing is the point at which the weight of the club is supported by the grip. The weight of the club pulls in the direction of gravity, and therefore the grip is formed so that the thumb of the left hand supports the weight of the club, against the direction of gravity. If the thumb of the left hand is unable to support the club against the direction of gravity, the grip cannot support the weight of the club at the top of backswing. Therefore, the difference between a good and bad grip depends precisely on whether the left thumb is supporting the club from below. If the left thumb strays even slightly from the support position, the grip cannot support the club weight, and the club inevitably slips downward.

C. Downswing and Impact

In the downswing motion, the power gathered in the backswing is slowly released, and follow-through takes place upon impact.

D. Finish

In the finish, the swing is completed after club head has struck the ball following the downswing.

The elements of a golf swing are the gathering of power in the backswing by moving the club (including the hands and arms) and the club face, and then gradually releasing that power in the downswing so as to strike the ball with maximum power and speed. In other words, the backswing must be an opening motion in which the body, arms, hands, club and club face move properly so as to gather strength, and the downswing must be a closing motion in which the gathered strength is slowly released and the club and club face return to the position they held in the address position. It is only possible to make a swing at the appropriate speed, sending the ball to the target, if what was opened in the backswing in order to gather strength is properly closed in the downswing.

Most amateur golfers open the body, arms, hands, club and club face relatively well in the backswing, but when closing in the downswing their release of power is not appropriate and the swing does not properly close the club face.

The cause of the open club face failing to close properly when power is released must be sought in the individual motions making up the swing. However, it is well-known among golfers that most such causes reside in the grip. The swing and downswing motions use large muscles, but the grip motion uses relatively fine muscles. The reason can be found in the fact that while large muscles retain motor memory over a long period, the motor memory of small muscles is not long-lasting. In other words, large muscles can retain the same motion, but small muscles do not maintain the same motion even if particular attention is given.

Here follows a consideration of proper and improper grips.

A proper grip leads to a suitable swing. Here, a "suitable swing" denotes a swing which can result in a shot moving the ball precisely in the direction of the target. This is the kind of suitable swing we want. However, an improper grip is unlikely to produce a suitable swing.

Developments in golf club manufacturing technology have changed swing patterns. However, while there have been many such changes in the swing, there has been no major shift in grip, address position, and other fundamental motions. The grip is the most fundamental element in a golf swing.

Nonetheless, most amateur golfers are unaware of the importance of the grip. Most seek only to improve their swing, and do not inspect their grip. This is in contrast to professional golfers, who uniformly begin by checking their grip.

The grip position has an enormous influence on the outcome of the swing. The most common flaw in the grip is the length of skin contact the bottom of the base of the forefinger and the second joint of the thumb. If the grip on the club handle is such that the bottom of the base of the forefinger and the second joint of the thumb are separate, there will be too much space between the hands and the club handle will slip from the hands. In this sort of grip, there is no connection between the hands and the club will turn between the hands at the time of the swing. Additionally, this has the problem that in a strong swing the wrists will go turn too far and the impact will not be precise. If the impact is not precise, both the distance and the direction of the ball will be incorrect.

A proper grip for suitable swing is one in which the bottom of the base of the forefinger touches the second joint of the thumb (refer to FIGS. 5 and 6). The form of the grip which brings both hands together in this fashion can be explained as follows, with reference to the diagrams.

1) First, the thumb and forefingers of each hand must be connected as shown in FIG. 5, in a preparatory position in which the two hands can be brought together as one.

"The bottom of the base of the forefinger (20) meeting the second joint of the thumb (10)" can be further explained as follows.

The thumb (10) is located at the extreme bottom position, unlike the other four fingers. In addition, it is shorter than the forefinger (20).

"The bottom of the base of the forefinger (20) meeting the second joint of the thumb (10)" means that the third joint of the forefinger (20) is not touched, but instead the bottom of the base of the forefinger (20) is in close skin contact with the second joint of the thumb (10).

This can be described in somewhat greater detail as follows, with reference to FIGS. 5 and 6.

The first joint of the thumb (10) is represented by $S_1$, the third joint of the forefinger (20) by $S_3$, the point between the forefinger (20) and thumb (10) by O, and the length of $OS_1$ by l.

The length of close skin contact (d) between the bottom of the base of the forefinger (20) and the second joint of the thumb (10), at the point O, is given by the formula d=(½~¾)□l. The exact value varies because the lengths of the thumb (10) and forefinger (20) vary from one person to another.

The optimal length of close skin contact for a proper grip is d=⅔□l.

This length of close skin contact between the bottom of the base of the forefinger and the second joint of the thumb is hereinafter referred to as the Skin Contact Length (d).

The bottom of the base of the forefinger refers specifically to the bottom of $S_3$, the third joint of the forefinger (20).

2) In the following motion, the left hand is touched to the right hand, without grasping the handle of the club (40). The left thumb and the lifeline of the right palm fit together like puzzle pieces.

3) The grip is made so as to bring the bent back portion of the left thumb together with the thick part of the right palm. (FIG. 6)

Experts recommend practicing the grip without a club in this fashion, regardless of time and place, using only one's hands. This signifies how difficult it is to maintain a proper grip even on the basis of repeated practice, although the grip is the most fundamental element in golf. The fact that a change in the location of a single finger from its proper location can cause a strange sensation and cause the ball not to be hit correctly is something learned from experience.

In as much as a proper grip is one in which the thumb (10) and forefinger (20) are in skin contact over Skin Contact Length (d), the thumb (10) and forefinger (20) must consciously be held closely together over the Skin Contact Length (d).

A proper grip is not just a grip that results in a suitable swing, but is also a grip that brings both hands firmly together; this is because in a proper grip the club does not turn in the hands at the time of the swing.

Once the grip is completed with Skin Contact Length (d) maintained, the backswing follows.

Now consider the role of the thumb (10) at the top of backswing.

At the top of backswing, the thumb (10)'s role is to support the full weight of the club.

Because a proper grip requires that the thumb (10) be pressed against the bottom of the base of the forefinger (20) over Skin Contact Length (d), this condition must be maintained even at the top of backswing.

Because the weight of the club (40) pulls in the direction of gravity, at the top of backswing the thumb (10) must provide support opposite the direction of gravity. Only if the direction of the thumb (10) is directly in line with the direction of gravity will the thumb be able to support the weight most comfortably while bearing the least load. In so far as support is provided in the most comfortable fashion, the same grip from the addressing will be maintained intact.

However, if the direction of the thumb (10) strays even slightly from opposite the direction of gravity, the thumb (10) will need proportionately more strength to maintain support. This is because, to the extent that the thumb is slanted, more vertical force is needed in order to support the weight of the club (40) against the direction of gravity.

The thumb (10) feels uncomfortable due to the proportionately added strain.

In this condition, the direction of support which feels least strenuous and most comfortable is the direction of gravity; therefore, the slanted thumb (10) unconsciously shifts toward the direction of gravity. The hand is prompted to move so as to grasp the club (40) handle in the direction of gravity by moving the thumb (10).

Therefore the grip of the address position ultimately cannot be maintained at the top of backswing, due to the movement of the thumb (10). Due to the thumb movement, the direction of the club (40) head also changes.

If the same grip is not maintained from the address position to the top of backswing, a suitable swing is unlikely.

In other words, if the thumb (10) is moved at the top of backswing, the location of the gripping hand shifts and the club (40) head does not impact the ball squarely when the swing is made. Because the ball is not impacted squarely, the ball does not go in the target direction and a missed shot results.

It can well be said that the chief cause of missed shots lies in the grip.

This is also the reason why golf experts emphasize the grip.

In the following, the relation between missed shots and the grip is considered.

Just as a proper grip is one in which the thumb (10) and forefinger (20) are consciously brought together, an improper grip is one in which the thumb (10) and forefinger (20) are not brought together, but are separated.

However, the difference in comfort between a proper and an improper grip is not easily perceived. This is because if people feel even slightly uncomfortable they tend unconsciously to seek comfort.

Thus it is not so easy to maintain the Skin Contact Length (d) between the thumb (10) and forefinger (20) from address position through the top of backswing to the moment of impact.

The muscles of the thumb (10) and forefinger (20) are much smaller than the muscles of the shoulders or back. For such small muscles, even supporting the weight of the club (40) is stressful. It is particularly difficult to keep the thumb (10) and forefinger (20) together while supporting the weight of the club (40) at the top of backswing. As soon as the thumb (10) begins to feel strain from the weight of the club(40), the thumb (10) moves unconsciously to the most comfortable position it can assume; this is common knowledge.

Simply separating the thumb (10) from the forefinger (20) makes both the thumb (10) and forefinger (20) more comfortable.

This is because, if it were comfortable for the thumb (10) and forefinger (20) to be held together there would be no need consciously to hold the thumb (10) and forefinger (20) together. However, this is not the case in reality. In fact, the grip is most comfortable when the thumb (10) and forefinger (20) are separated and not held together.

However, all golfers are alike in desiring a suitable swing. To this end, they must consciously practice holding the thumb (10) and forefinger (20) together over the Skin Contact Length (d). However, no amount of practice is sufficient to be able always to hold the grip with the thumb (10) and forefinger (20) always together over the Skin Contact Length (d). This is because small muscles such as those in the thumb (10) and forefinger (20), unlike large muscles such as those of the back, move less in response to memory than in response to sensation.

Thus, while many large muscles characteristically retain memory of repeated motions over a long period, small muscles characteristically retain memory poorly regardless of the amount of practice. To put it another way, large muscles are capable of repeating the same action in the same degree, but small muscles cannot be expected to repeat a remembered action; instead, they move in response to sensation.

Unlike movement in response to repeated practice and memory, movement in response to sensation is difficult to shape into a specific motion; therefore, a grip can only be achieved through conscious effort.

"Conscious effort" here refers not only to the effort to bring the thumb (10) and forefinger (20) together at the Skin Contact Length (d), but also the effort to keep the thumb (10) and forefinger (20) together at Skin Contact Length (d) at the top of backswing.

Even with conscious effort, there are limits to the ability to consciously repress the unconscious movement to separate the thumb (10) and forefinger (20) for the sake of comfort.

Even if the thumb (10) and forefinger (20) are consciously held together for the Skin Contact Length (d), when the mind is focused on the backswing motion the thumb (10) and forefinger (20) will begin moving to a more comfortable position and slip apart. Because the backswing motion is instantaneous, the golfer is not even aware that the thumb (10) and forefinger (20) have separated.

In practice, conscious awareness of the grip cannot be maintained while also focusing on the backswing.

If gloves are worn, it becomes even more difficult to be conscious of the condition of the grip, because there is no sensation of the thumb (10) and forefinger (20) being pressed together over the Skin Contact Length (d) when the outside of the glove covering the left thumb (10) is touching the outside of the glove covering the forefinger (20). However, it is possible to sense the contact of the skin of the thumb (10) and forefinger (20) over the Skin Contact Length (d) when using bare hands, without gloves.

In theory, it is much easier to maintain the connection between the thumb (10) and forefinger (20) consciously through the sense of touch not only at the address position, but also at the top of backswing, when using bare hands than when wearing gloves.

In most cases, the grip is held firmly with the third, fourth, and fifth (little) fingers, so as to prevent the club from slipping out of the left hand due to centrifugal force, and gently with the first and second fingers (thumb and forefinger, respectively).

Gloves oppose this centrifugal force with friction, because the third, fourth, and fifth fingers act to preventing the club from slipping out of the hand at the time of the swing. The friction between the gloves and the club handle provides support against the centrifugal force of the swing.

If gloves are not worn, the friction is directly between the hands and the club handle; therefore, calluses and other scars appear on the third, fourth, and fifth fingers. In addition to this, in the summer if the golfer sweats the handle becomes slippery and can easily slip out of the grip.

For these reasons, gloves are worn.

However, the thumb and forefinger play no role in providing support against centrifugal force, unlike the third, fourth, and fifth fingers. Because they play no role in resisting centrifugal force, the thumb and forefinger do not grasp the club handle as firmly as the third, fourth, and fifth fingers. Their only role is to guide a suitable swing. In order to play a guiding role, they must grip the handle gently. The more gently they grip, the more possible it is to have a suitable swing.

The thumb and forefinger are held together in order to grasp the club handle gently.

In order for the thumb and forefinger to grip the club handle gently, it would be preferable not to wear gloves. This is because with the bare hands it is possible to perceive directly, by touch, the strength with which the club handle is gripped. When gloves are worn, there is no direct skin contact and perception is dulled; consciously or unconsciously, this ordinarily results in the club being gripped firmly.

When strength is applied to the thumb and forefinger, the thumb and forefinger experience discomfort and separate from one another. In this eventuality a suitable swing is impossible because the grip is not correct.

To put this another way, when swinging it is best for the third, fourth, and fifth fingers to be gloved, but for a proper grip and a suitable swing it is best for the thumb and forefinger to be ungloved.

DISCLOSURE OF INVENTION

Technical Problem

The golf gloves which have been in general use heretofore either 1) enclose all four fingers, 2) are cut off at roughly the second joint of all five fingers, or 3) are cut off only at the first joint of the thumb and the second joint of the forefinger.

The fact that the thumb and forefinger must be kept together means specifically that the bottom of the base of the forefinger must be in close skin contact with the area of the second joint of the thumb. Considered in this light, gloves of types 2) and 3) are of an open form quite different from what is needed in order for the golfer to perceive the needed skin contact between the thumb and forefinger.

Because all golf gloves of the prior art are thus of a structure with two layers intervening between the thumb and forefinger, there is no skin contact whatsoever. This structure does not permit the golfer to sense whether the thumb and forefinger are pressed together.

Even if the golfer is aware that the thumb and forefinger must be kept together, due to the lack of skin contact the thumb and forefinger can easily slip apart in the course of the backswing.

Therefore, one approach to acquiring a proper swing by keeping the thumb and forefinger together is for the golfer to be apprised of the skin contact through direct sensation, because the motion is not directed from repeated memory but from conscious perception.

Hereinabove, the grip between the left thumb and the forefinger has been considered.

Hereinbelow the relation between the left thumb and the right hand will be considered.

In a suitable swing, the left and right hands are held together as one. In order for the left thumb and right hand thus to be held together, the left thumb must be firmly inserted into the lifeline of the right hand.

A sense of skin contact is felt due to the direct skin contact between the left thumb and the lifeline of the right hand.

However, because gloves of the prior art enclose the left thumb, this sensation cannot be felt because there is no skin contact with the lifeline of the right hand. Even if it can be felt, it is not long-lasting. This is because the sense of skin contact arises not from muscular memory but from sensation. The problem is that because these are not large muscles, the sense of skin contact is easily lost.

If the sense of skin contact is lost, more power will go into the grip or the location of the grip will shift at the top of backswing, and a suitable swing will become impossible.

In as much as the chief cause of the loss of a sense of skin contact between the left thumb and right lifeline resides in the glove covering the left thumb, one solution is to remove the glove covering from the left thumb.

If the left thumb and right lifeline are in direct skin contact, the sense of skin contact will not easily be lost even during the swing. Upon experimenting with wearing no glove on the left hand and bringing it into direct skin contact with the right hand, it was found that the sense of skin contact lasted much longer than was the case when the left hand was ungloved.

Therefore, in order for the left and right hands to come together as one, the optimal choices are either for no glove to be worn on the left hand, or for the covering on the thumb portion of the left glove to be removed.

However, if no glove is worn on the left hand it is likely that the third, fourth and fifth fingers will be injured, and in addition that hand sweat in the summer will cause the club to slip out of the hands.

Therefore, in as much as gloves must be worn on the left hand, there is a need for gloves which can induce a suitable swing, a good grip, and a sense of skin contact between the left and right hands.

Such golf gloves are the invention disclosed in the present application.

In as much as a proper grip for a suitable swing is one in which the bottom of the base of the forefinger touches the area of the second joint of the thumb, in order for the golfer to remain aware of this connection over time, the most important thing is that the bottom of the base of the index finger and the second joint of the thumb be in direct skin contact.

To this end, the invention is configured so that there is no covering on the thumb, starting from the low point between the thumb and forefinger and continuing at or below the circumference of the thumb.

If the uncovered left thumb comes into abundant skin contact with the covering of the bottom of the base of the index finger, over time the sensation of skin contact felt from the left thumb will increase. The skin sensation felt by the thumb spreads throughout the left hand and it comes to feel as if no glove were on the left hand at all. This transmission of the feeling from the left thumb throughout the left hand is a miracle unique to the hands. There is no other explanation.

Technical Solution

The present invention comprises a glove from which the thumb portion is omitted, so as to furnish a golf glove which induces proper grip and consequently a suitable swing.

The opening was formed so as to be at or below the circumference of the thumb, centered at the low point formed between the thumb and forefinger when the thumb and forefinger are spread apart.

In addition, a skin contact hole was formed in the bottom of the base of the forefinger corresponding to the Skin Contact Length (d), in order to increase skin sensation further.

The portion of the glove which is stretched by the centrifugal force of the club (40), namely the P area, was entirely composed of Spandex having excellent elasticity and flexibility; therefore this quickly returns to its original state and the glove always retains its original shape.

The invention disclosed in the present application thus permits a proper grip to be maintained through skin sensation, and as a result a golf glove for a proper grip and suitable swing is furnished which enables a suitable swing.

Advantageous Effects

This invention enables a suitable swing by allowing the golfer to perceive that the thumb and forefinger are in skin contact for the Skin Contact Length (d), and also by allowing this perception to continue from the address position through the backswing to the moment of impact, by furnishing a glove from which the thumb portion has been removed starting at the low point between the thumb and forefinger and continuing at or below the circumference of the thumb.

In addition, an even more suitable swing is enabled by permitting the golfer to remain aware of the skin contact between the bottom of the base of the forefinger and the second joint of the thumb through the formation of a skin contact hole in the bottom of the base of the forefinger which corresponds to the Skin Contact Length (d) and allows the thumb and forefinger to be in direct skin contact.

The entire P area at the base of the thumb opening is formed of Spandex or a mixture of Spandex and leather forming a two-layer structure; thus, not only is any stretching or expansion of the covering around the thumb opening prevented, but even if the P area is pulled by the centrifugal force of the golf club the glove returns to its original condition; the effect of this is that the gloves always retain their original condition without stretching.

In addition, this invention has the useful effect that the area between the thumb and forefinger is comfortable because the material is Spandex, and the portion touching the left thumb feels soft and does not create a sense of heterogeneity; also, stitches are made from the low point (O) between the thumb and forefinger toward the forefinger to prevent stretching, and these stretch-prevention stitches prevent the Spandex covering of the glove between the thumb and forefinger from stretching in or below the direction of the thumb.

BRIEF DESCRIPTION OF THE DRAWINGS

FIG. 1 is an outline perspective view showing a grip made using the golf gloves for proper grip and suitable swing of this invention.

FIG. 2 is an outline perspective view showing the grip made with the golf gloves of this invention constructed according to another preferred embodiment.

FIG. 3 is a perspective view showing the left palm (LF) with the thumb and forefinger spread apart.

FIG. 4 is a perspective view showing the back of the left hand (LB) with the thumb and forefinger spread apart.

FIG. 5 is a perspective view showing the left and right hands with the thumb and forefinger in skin contact for a proper grip.

FIG. 6 is a perspective view showing the left and right hands of FIG. 5 in a proper grip.

FIG. 7 is a perspective view showing the left hand in a proper grip position.

FIG. 8 is a perspective view showing the golf gloves of this invention in grip position.

FIG. 9 is a perspective view showing the palm side of the golf glove of this invention with the entire P area composed of leather.

FIG. 10 is a perspective view showing the back side of the golf glove of this invention with the entire P area composed of leather.

FIG. 11 is a perspective view showing the palm side of a golf glove constructed according to another preferred embodiment of this invention with the entire P area composed of Spandex.

FIG. 12 is a perspective view showing the back side of a golf glove constructed according to another preferred embodiment of this invention with the entire P area composed of Spandex.

FIG. 13 is a perspective view of the palm side of a golf glove constructed according to an additional preferred embodiment of this invention with a two-layer structure with the P area composed of Spandex and the $P_1$ area composed of leather for a proper grip and suitable swing.

FIG. 14 is a perspective view of the back side of an additional preferred embodiment of the golf glove of this invention having a two-layer structure with the P area composed of Spandex and the $P_1$ area composed of leather.

FIG. 15 is a perspective view of the preferred embodiment of this invention shown in FIG. 13, with incisions in the two-layer structure.

FIG. 16 is a perspective view showing the plane separating the $P_1$ and $P_2$ areas of the two-layer structure of FIG. 15.

BRIEF EXPLANATION OF SYMBOLS IN THE DRAWINGS

L; Left hand LF; Left palm
LB; Left hand back R; Right hand
RF; Right palm RB; Right hand back
10; Thumb 20; Forefinger
O; Low point S1; First thumb joint
S2; Second thumb joint S3; Third forefinger joint
A; Thick area of palm d; Skin Contact Length
30; Glove 31; Incision
32; Opening 33; Thumb covering
35; Skin contact hole 37; Stitches
37*a;* Stretch-prevention stitch 39; Spandex
40; Club

BEST MODE FOR CARRYING OUT THE INVENTION

The configuration of the invention and the diagrams can be described in detail as follows.

The golf glove for proper grip and suitable swing of this invention is configured with an opening (32) such that there is no covering over the thumb area (see FIGS. 1 and 2). In particular, because this is for a proper grip and suitable swing, the location of the thumb area is of the greatest importance.

Only when the bottom of the base of the forefinger (20) and the second joint of the thumb (10) are held together are a proper grip and suitable swing possible; therefore, the location where the thumb (10) area is absent is the area where the primary skin contact between the bottom of the base of the forefinger (20) and the thumb (10) will take place.

If the location where the thumb area is removed is as aforedescribed, the area where the basal face of the thumb contacts the handle of the club (40) also increases (see FIG. 8), not only increasing the sensation of the skin but also preserving a proper grip and suitable swing.

In that case, when the left thumb (10) and forefinger (20) are spread apart (see FIGS. 3 and 4), it would be better to form the opening (32) of the glove lacking a thumb covering at the low point (O) between the thumb (10) and forefinger (20), the opening generally in line with or larger than the lower circumference area of the thumb (10). (See FIGS. 10, 12, and 14.)

The above statement that the edge of the opening (32) of the glove (30) lacking a thumb area is located at or below the lower circumference area of the thumb signifies that the edge of the opening can be located anywhere between the direction of the thumb circumference and the direction of the wrist.

However, the left hand is not the same size for all people. Even if all gloves are made in the same size and shape, the location of the low point (O) will differ depending on the size and shape of the hand.

In view of this, the reference to the low point (O) between the thumb and forefinger actually signifies the area in the vicinity of this point.

The larger the area of skin contact between the left thumb (10) and the club (40) handle, the more suitable is the sensation for a proper grip and suitable swing; therefore, if there is no problem with the exterior of the golf glove there will be no problem with the location of the omitted portion on the back of the glove. With regard to the outside of the glove, it is preferred that the omitted portion be in the area where the bone sticks out in the thumb (10) area of the back of the hand (LB), namely the $S_2$ area or below. (See FIGS. 10, 12, and 14.)

Since a proper grip for suitable swing requires that the golfer remain aware of skin contact between the bottom of the base of the forefinger (20) and the second joint of the thumb (10), it is preferred that a small skin contact hole (35) also be formed in the bottom of the base of the forefinger (20). (See FIG. 2.) Because the skin contact hole (35) and the thumb (10) come into direct skin contact, it is possible for the golfer to remain aware that the bottom of the base of the forefinger (20) is touching the second joint of the thumb (10).

In as much as the effect is increased the greater the area of skin contact with the thumb (10), as long as the shape and size of the aforementioned skin contact hole (35) is appropriate to this, the exact size is unimportant.

On the other hand, without additional finishing touches it is impossible to prevent the stretching and expansion of the edge of the opening (32) in the glove (30) due to the centrifugal force of the club (40), and in addition the glove covering is pulled toward the palm and the palmar covering is also stretched. This is because ordinary golf gloves are made of inelastic leather or an inelastic fabric or synthetic resin.

In particular, if the palm of the glove lacking a thumb covering (30) is stretched it is not possible to hold a proper grip. This is due to the stretched palmar covering being folded in the process of gripping the club (40) and then pulling in turn on the left thumb. If the left thumb is not free, a proper grip is obviously impossible.

The P area is the primary area of the glove (30) that is stretched by the centrifugal force of the club (40). Because the glove is thumbless, the stretching phenomenon is more severe than in a five-fingered glove. The stretching of the golf glove not only renders a suitable swing difficult due to the impossibility of a proper grip, but also leads to wounds and calluses on the palm and fingers due to the folding which takes place in severe stretching.

The P area is the area centered on the thumb and stretching from the thick portion of the palm to the back of the hand along the base of the thumb. (See FIGS. 9~15.) The area most prone to stretching is precisely this thick area of the palm.

When the centrifugal force from the club (40) is repeatedly imparted, the stretching of the leather accumulates in the thick area of the palm.

This accumulation of stretching is due to leather's lack of elastic properties.

In the present invention, in order to restore the P area to its original condition, Spandex (39) having good elasticity and flexibility is used to provide elasticity to the leather. Of course, although the material of the gloves (30) used in this invention has been described for convenience as leather, the same concept applies if the glove uses any other material which is similarly lacking in elasticity or flexibility.

Spandex is a thin woven fabric with excellent flexibility and elasticity.

The entire P area is formed of Spandex (39) and this is stitched together with the rest of the glove. Due to the Spandex (39), the area touching the left thumb is soft to the touch and there is no sense of heterogeneity. In addition, because the entire P area is Spandex material (39), even if the P area is stretched by the centrifugal force of the club (40), it quickly returns to its original unstretched state and always retains its original shape.

Elasticity is maintained even if a two-layer structure of Spandex (39) and leather is formed through the addition of the leather of the glove (30) along the bottom of the thumb opening (32) on top of the Spandex material (39), covering the entire P area. The portions on which a leather layer is formed are as shown in the $P_1$ area in FIGS. 13 and 15, and the portions of directly-exposed Spandex material are as shown in the $P_2$ area.

Because the $P_1$ and $P_2$ areas both have a base of flexible, elastic Spandex, the exact size of the $P_1$ and $P_2$ areas is immaterial, as long as the elasticity of the Spandex (39) is maintained.

Additionally, it is permissible for an incision (31) to be made in the leather of the $P_1$ area in order to enhance elasticity. (See FIGS. 15 and 16.) Furthermore, it is preferred that 1~3 stretching-prevention stitches (37*a*) be made in parallel from the low point (O) between the thumb (10) and forefinger (20) toward the forefinger (20). This is to make the thumb (10) and forefinger (20) rest more comfortably together, through the prevention of stretching of the Spandex (39) covering of the glove (30), which has been formed between the thumb (10) and forefinger (20), in the direction of the thumb or below, due to the stretching-prevention stitches (37*a*).

INDUSTRIAL APPLICABILITY

This invention has the effect of enabling a more suitable swing by allowing the golfer to remain aware longer of the fact that the bottom of the base of the forefinger is touching the second joint of the thumb due to direct skin contact between the thumb and forefinger via the skin contact hole which has been formed in the bottom of the base of the forefinger corresponding to the Skin Contact Length (d), at or below the circumference of the thumb and centered on the low point between the thumb and forefinger which is formed when the thumb and forefinger are spread apart.

Because the entire P area around the base of the thumb opening is composed either of Spandex or of a two-layer system comprising Spandex and leather, any stretching or expansion of the covering around the thumb opening is prevented, and in addition even if the P area is pulled by the centrifugal force of the golf club it returns again to its original unstretched state and always preserves the glove's original shape.

In addition, this invention has the useful effect that the area between the thumb and forefinger is comfortable because the material is Spandex, and the portion touching the left thumb feels soft and does not create a sense of heterogeneity; also, stitches are made from the low point (O) between the thumb and forefinger toward the forefinger to prevent stretching, and these stretch-prevention stitches prevent the Spandex covering of the glove between the thumb and forefinger from stretching in or below the direction of the thumb.

The invention claimed is:

1. A golf glove without having a thumb covering, the golf glove defining an opening (32) for exposing a thumb (10) of a golfer with a circumferential area of the opening (32) lying about a lower circumference of the thumb so as to enable a bare skin exposed at a lower side of the thumb to contact with a lower side area of a forefinger region (20) when the golf glove is worn by the golfer, and also to further enable a direct skin contact between the exposed thumb and a handle portion of a golf club (40), wherein the golf glove is made of leather or inelastic fabric or synthetic materials except an area (P), which is a region adjacent to the opening (32) in the glove and including a root portion of the thumb at a palm side, which is made of an elastic material or a Spandex material having good flexibility and elasticity.

2. A golf glove without having a thumb covering, the golf glove defining an opening (32) for exposing a thumb (10) of a golfer with a circumferential area of the opening (32) lying about a lower circumference of the thumb so as to enable a bare skin exposed at a lower side of the thumb to contact with a lower side area of a forefinger region (20) when the golf glove is worn by the golfer, and also to further enable a direct skin contact between the exposed thumb and a handle portion of a golf club (40), wherein an area (P) adjacent to the opening (32) in the glove is made with an elastic material or a Spandex material having good flexibility and elasticity, the area (P) including a root portion of the thumb at a palm side, and wherein an area ($P_1$), on an outer portion of the area (P), includes a leather layer.

3. The golf glove of claim 1 or claim 2, wherein stretching-prevention stitches (37*a*) are made in parallel from a low point (O) between the thumb (10) and forefinger (20) toward the forefinger (20).

4. The golf glove of claim 2, wherein a number of incisions (31) are made in the leather layer of the $P_1$ area.

5. The golf glove of claim 1 or claim 2, wherein the golf glove includes a skin contact hole (35) adjacent to the opening (32) to enable a direct contact between a lower portion of the exposed thumb and the skin on a root portion of the forefinger through the skin contact hole (35).

* * * * *